US006986691B2

(12) United States Patent
Johnson et al.

(10) Patent No.: US 6,986,691 B2
(45) Date of Patent: Jan. 17, 2006

(54) FOAM STABILIZATION FOR PERSONAL FLOTATION DEVICE

(75) Inventors: Jean Johnson, South Haven, MN (US); Marcy Carlson, St. Joseph, MN (US); Brenda Espelien, St. Cloud, MN (US)

(73) Assignee: Steams Inc., Sauk Rapids, MN (US)

( * ) Notice: Subject to any disclaimer, the term of this patent is extended or adjusted under 35 U.S.C. 154(b) by 0 days.

(21) Appl. No.: 10/681,793

(22) Filed: Oct. 8, 2003

(65) Prior Publication Data

US 2005/0079778 A1 Apr. 14, 2005

(51) Int. Cl.
*B63C 9/08* (2006.01)

(52) U.S. Cl. ..... 441/106; 2/67

(58) Field of Classification Search ..... 441/106–119; 2/67, 267; 434/254; 482/55
See application file for complete search history.

(56) References Cited

U.S. PATENT DOCUMENTS

| | | | | | |
|---|---|---|---|---|---|
| 727,444 | A | | 5/1903 | Recordon | |
| 1,829,090 | A | | 10/1931 | Harris | |
| 2,629,116 | A | * | 2/1953 | Frieder et al. | 441/116 |
| 2,629,118 | A | * | 2/1953 | Frieder et al. | 441/110 |
| 3,366,984 | A | * | 2/1968 | Le Blanc, Jr. | 441/118 |
| 3,416,172 | A | | 12/1968 | Gerling | |
| 3,425,072 | A | | 2/1969 | Carlson | |
| 3,540,067 | A | | 11/1970 | Deruaz | |
| 4,934,973 | A | | 6/1990 | Taylor | |
| 4,936,805 | A | * | 6/1990 | Piatt, Jr. | 441/106 |
| 5,295,884 | A | | 3/1994 | Whiteley | |
| 5,342,232 | A | | 8/1994 | Bardot | |
| 5,588,891 | A | | 12/1996 | Bardot | |
| 5,820,432 | A | * | 10/1998 | Wright | 441/119 |
| 5,928,046 | A | | 7/1999 | Constan-Tatos | |
| 6,056,613 | A | * | 5/2000 | Pike | 441/129 |
| 6,659,689 | B1 | * | 12/2003 | Courtney et al. | 405/186 |

* cited by examiner

*Primary Examiner*—Andrew D. Wright
(74) *Attorney, Agent, or Firm*—Black Lowe & Graham; Darren J. Jones

(57) ABSTRACT

The present invention comprises a system and method for improved stabilization of multiple layers of flexible foam material in personal flotation devices. The present invention includes front and back covered segments incorporating multiple layers of buoyant material connected together by fabric inserted into one or more slits formed through the layers. The ends of the fabric are preferably sewn together. In an alternative embodiment, the connected multiple layers of buoyant material are secured within the covered segments by affixing them within the covered segments. The present invention provides improved stabilization of multiple layers of flexible foam material when used in personal flotation devices to reduce curling and fanning issues and avoid bulk and weight while providing a cosmetically appealing flotation device.

19 Claims, 6 Drawing Sheets

FOAM STABILIZATION FOR PERSONAL FLOTATION DEVICE

FIELD OF THE INVENTION

This invention relates generally to personal flotation devices and, more specifically, to foam stabilization for personal flotation devices.

BACKGROUND OF THE INVENTION

Approved United States Coast Guard personal flotation devices are required for many water activities. Personal flotation devices come in many shapes, colors and materials, but typically incorporate buoyant foam material. A popular type of personal flotation device is designed as a vest that fits around the user's neck and upper torso, commonly secured to the user via a zipper, adjustable straps or belts.

Swimwear-style personal flotation devices have been developed, particularly for use with children. These devices incorporate buoyant foam material into a garment designed for continuous wear, similar to a swimming suit. As with most personal flotation devices, maintaining the location of the buoyant foam material with respect to the user's head and torso is critical to ensure proper flotation. Incorporating buoyant foam material into swimwear-style personal flotation devices has presented unique challenges. Should the buoyant foam material shift from its prescribed location in the chest and upper back areas, or curl or fan excessively, the attitude of the user in the water can be adversely influenced and the personal flotation device not perform the functions for which it is intended.

Solid foam blocks have been used in swimwear-style personal flotation devices in an effort to achieve proper flotation. The solid foam blocks, for example made from PVC foam, have been sewn into various portions of the swimsuit in an effort to maintain buoyancy and balance when worn by a user in the water. Using solid PVC blocks reduce the likelihood that the buoyant foam material will curl or fan. However, solid foam blocks are bulky, add significant weight and cost to the product and are cosmetically unappealing.

Flexible buoyant foam material, for example multiple layers of the polyethylene foam more commonly found in traditional life jackets and vests, is a more promising alternative. Use of multiple flexible layers of buoyant material avoids much of the bulk and weight associated with solid foam blocks. The stretchy nature of the fabrics used as a shell and lining for swimwear-style personal flotation devices presents new challenges when multiple layers of buoyant material are used. While such layers maintain an ideal position in flotation garments made from limited stretch material such as woven fabrics or marine netting, when used in the stretchy swimwear-style fabrics (for example neoprene or knit fabrics), the layers tend to shift from the prescribed location or curl or fan excessively. This results in an undesirable change in the attitude of the user in the water and threatens the proper performance of the personal flotation device.

Prior attempts to solve problems associated with using multiple layers of polyethylene foam with swimwear-style personal flotation devices have been largely unsuccessful. Bonding the polyethylene foam layers together to form a single layer reduces the curling and fanning issues while avoiding the weight issues present when using solid blocks of foam. But this solution requires the addition of an adhesive application step, which in turn introduces significant complexities in the manufacture of the personal flotation device. It also raises questions about the durability of the bond over time and use. Finally, use of an adhesive introduces safety concerns about the proper ventilation for the adhesive, both during manufacture and subsequent storage by the seller and end user, as well as long term potential health effects on the user.

Sewing pieces of the swimwear-style fabric directly to the flexible foam material to serve as attachment points to secure the foam into the garment is likewise not feasible. Such stitching is not an option when using preferred polyethylene foam material in the thickness required in swimwear-style personal flotation devices.

Thus, there is a need for improved stabilization of multiple layers of flexible foam material when used in personal flotation devices to reduce curling and fanning issues and avoid bulk and weight while providing a cosmetically appealing flotation device.

SUMMARY OF THE INVENTION

The preferred embodiment of the present invention is directed to a personal flotation device including a cover forming one or more compartments incorporating flotation material consisting of multiple layers of flexible buoyant material adjacent to each other within the covered compartment. One or more apertures are made in the layers of buoyant material. A fabric band or belt is passed through each aperture in the layers of buoyant material, the ends of the layers preferably connected. The fabric band limits the movement of each layer of buoyant material relative to the other layers of buoyant material.

In an alternative embodiment, the fabric band is connected to the cover of the personal flotation device to limit the movement of each layer of buoyant material within the compartment.

In yet an alternative embodiment, the flotation stabilization system and method of the present invention is incorporated into a swimwear-style personal flotation device incorporating buoyant material into a garment designed for continuous wear, similar to a swimming suit.

Accordingly, the present invention provides for improved stabilization of multiple layers of flexible foam material when used in personal flotation devices to reduce curling and fanning and avoid bulk and weight while providing a cosmetically appealing flotation device.

BRIEF DESCRIPTION OF THE DRAWINGS

The preferred and alternative embodiments of the present invention are described in detail below with reference to the following drawings.

DESCRIPTION OF THE PRESENT INVENTION

The preferred embodiment of the present invention is directed to improved stabilization of multiple layers of flexible foam material in personal flotation devices. While the present invention has particular application when used in swimwear-style personal flotation devices, commonly referred to as personal flotation vests, it has general application to various types of personal flotation devices.

Figure 1:
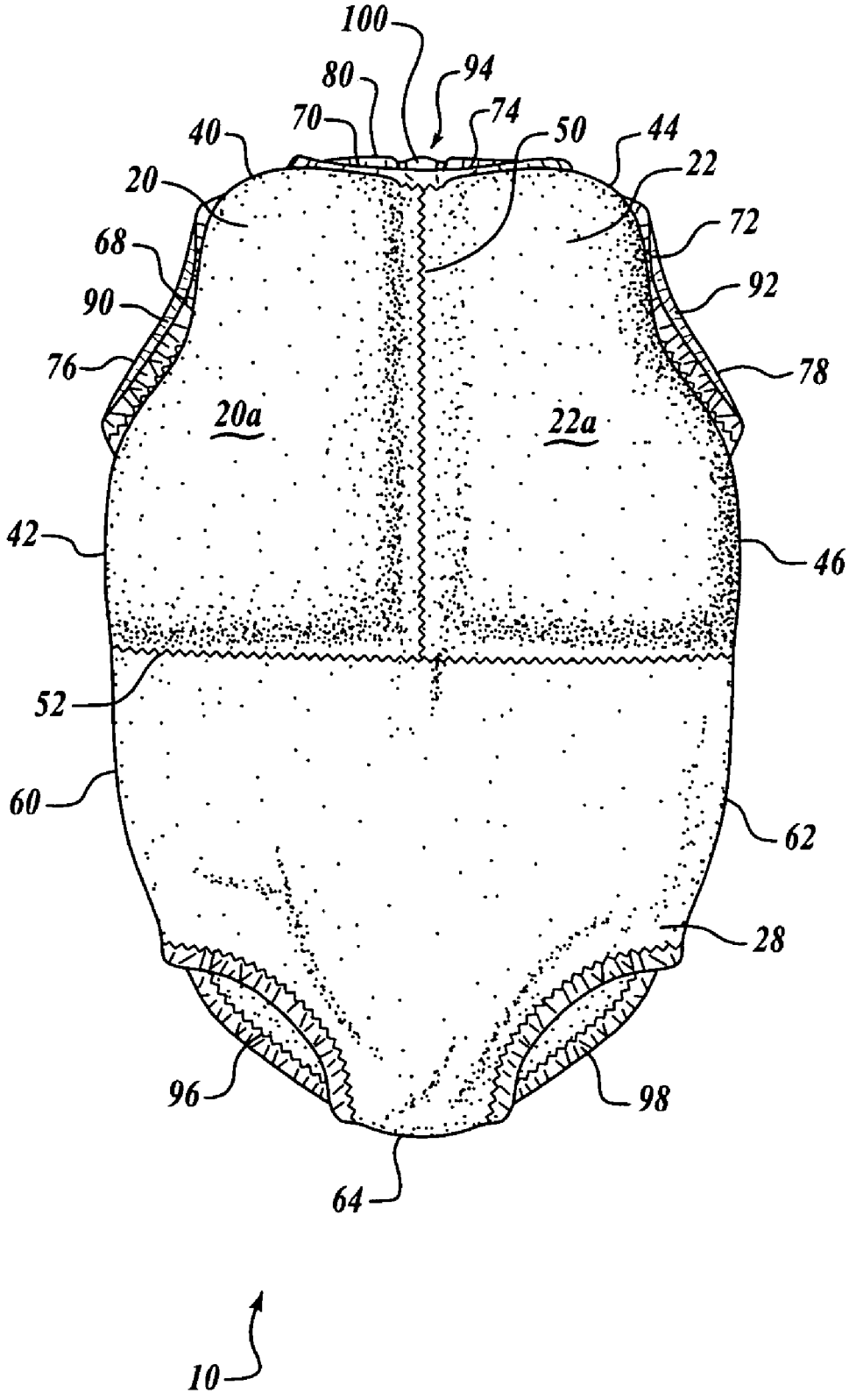
FIG. 1 is a front view of a swimwear-style personal flotation device for use in a preferred embodiment of the present invention.
Figure 2:
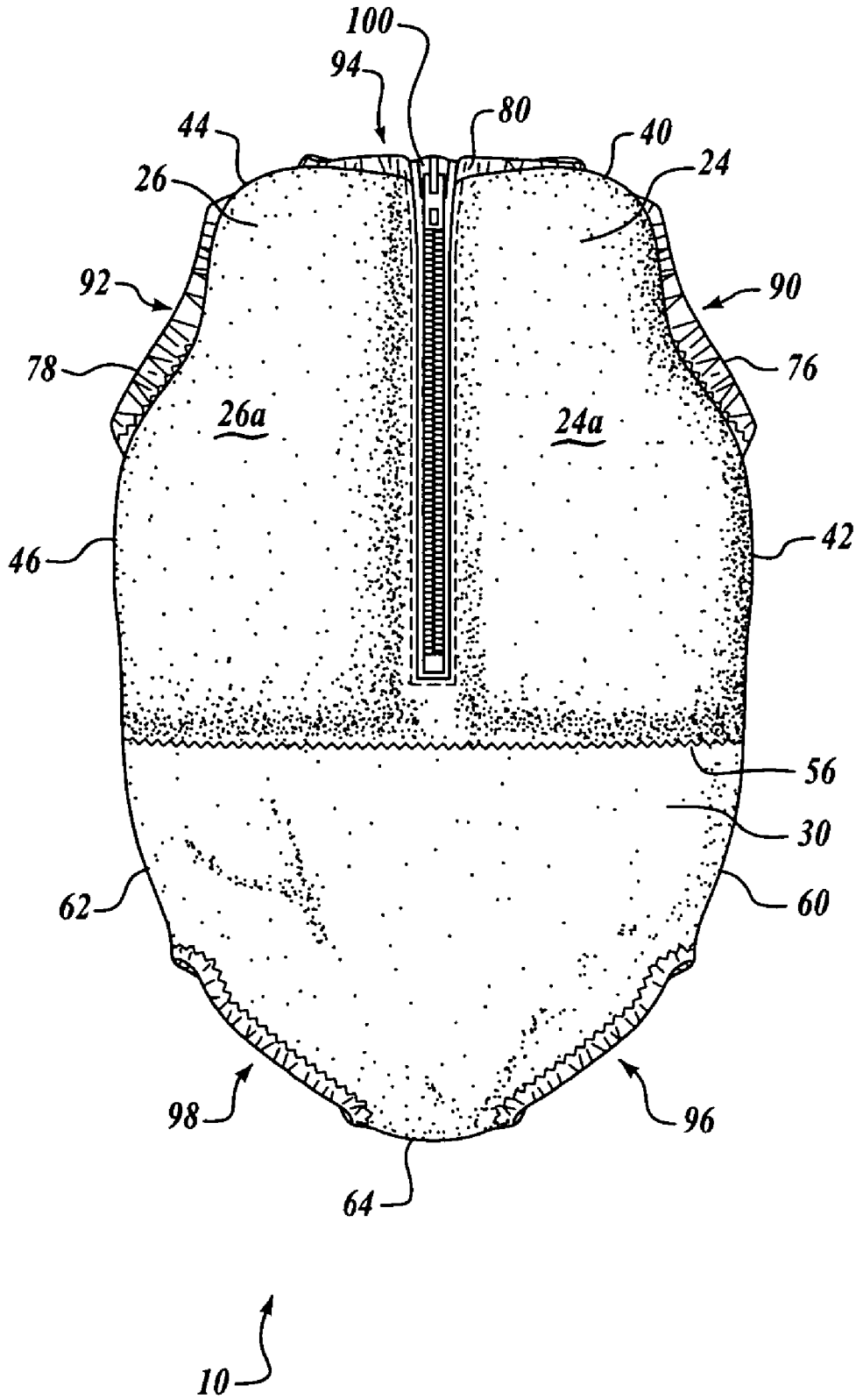
FIG. 2 is a back view of the preferred swimwear-style personal flotation device of FIG. 1.

With reference to FIGS. 1 and 2, the preferred swimwear-style personal flotation vest 10 includes a front right segment 20 incorporating a buoyant material (not shown), a front left segment 22 incorporating a buoyant material (not shown), a back right segment 24 incorporating a buoyant material (not shown), a back left segment 26 incorporating a buoyant material (not shown), a front swimsuit segment 28 and a back swimsuit segment 30. In the preferred embodiment, each segment is comprised of a flexible neoprene or stretchable fabric (for example knit fabric).

The front right segment 20, the front left segment 22, the back right segment 24 and the back left segment 26 are preferably connected together to form a vest shape. The right front segment 20 is connected to the back right segment 24 over the user's right shoulder (not shown) along seam line 40 and below a right arm opening 90 on the right side of the vest along seam line 42. The left front segment 22 is connected to the back left segment 26 over the user's left shoulder (not shown) along seam line 44 and below a left arm opening 92 on the left side of the vest along seam line 46. The front right segment 20 and the front left segment 22 are preferably connected along seam line 50. The back right segment 24 is preferably connected to the back left segment 26 via zipper 100. The connections between the front right segment 20, the front left segment 22, the back right segment 24 and the back left segment 26 form a neck opening 94 in the vest 10.

The front right segment 20 and the front left segment 22, joined along seam line 50, are connected to front swimsuit segment 28 along seam line 52. The back right segment 24 and the back left segment 26, joined via zipper 100, are connected to the back swimsuit segment 30 along seam line 56. The front swimsuit segment 28 is connected to the back right segment 24 and the back swimsuit segment 30 across the user's right hip (not shown) along seam 60. The front swimsuit segment 28 is connected to the back left segment 26 and the back swimsuit segment 30 across the user's left hip (not shown) along seam 62. The front swimsuit segment 28 and the back swimsuit segment 30 are connected along seam line 64 to form a right leg opening 96 and a left leg opening 98.

In the preferred embodiment, the front right segment 20, the front left segment 22, the back right segment 24 and the back left segment 26 each have exterior fabric shells 20*a*, 22*a*, 24*a* and 26*a* and corresponding interior fabric liners 20*b*, 22*b*, 24*b* and 26*b* (not shown). The exterior fabric shell 20*a* is preferably connected to the interior fabric liner 20*b* along seam lines 40, 42, 50 and 52 and along the front sleeve 68 of the right arm opening 90 and the front collar 70 of the neck opening 94. The exterior fabric shell 22*a* is preferably connected to the interior fabric liner 22*b* along seam lines 44, 46, 50 and 52 and along the front sleeve 72 of the left arm opening 92 and the front collar 74 of the neck opening 94. The exterior fabric shell 24*a* is preferably connected to interior fabric liner 24*b* along seam lines 40, 42 and 56, via zipper 100, and along the back sleeve 76 of the right arm opening 90 and the back collar 80 of the neck opening 94. The exterior fabric shell 26*a* is preferably connected to interior fabric liner 26*b* along seam lines 44, 46 and 56, via zipper 100, and along the back sleeve 78 of the left arm opening 92 and the back collar 80 of the neck opening 94. Connecting the exterior and interior segments is preferably accomplished by stitching the fabric of the adjoining segments together along the seam lines. The buoyant material incorporated into the front right segment 20, the front left segment 22, the back right segment 24 and the back left segment 26 is retained between exterior fabric shells 20*a*, 22*a*, 24*a* and 26*a* and corresponding interior fabric liners 20*b*, 22*b*, 24*b* and 26*b*.

In a preferred embodiment, the front right segment 20, the front left segment 22 and the front swimsuit segment 28 are formed of a single piece of fabric and the back right segment 24, the back left segment 26 and the back swimsuit segment 30 are formed of a separate, single piece of fabric. In this embodiment, the front right segment 20 incorporating a buoyant material (not shown), the front left segment 22 incorporating a buoyant material (not shown) and the front swimsuit segment 28 are connected to the back right segment 24 incorporating a buoyant material (not shown), the back left segment 26 incorporating a buoyant material (not shown) and the back swimsuit segment 30 along seam lines 40–46, 50–52, 56, and 68–80 and via zipper 100. Connecting the segments is preferably accomplished by stitching the fabric of the adjoining segments together along the seam lines.

Figure 3:
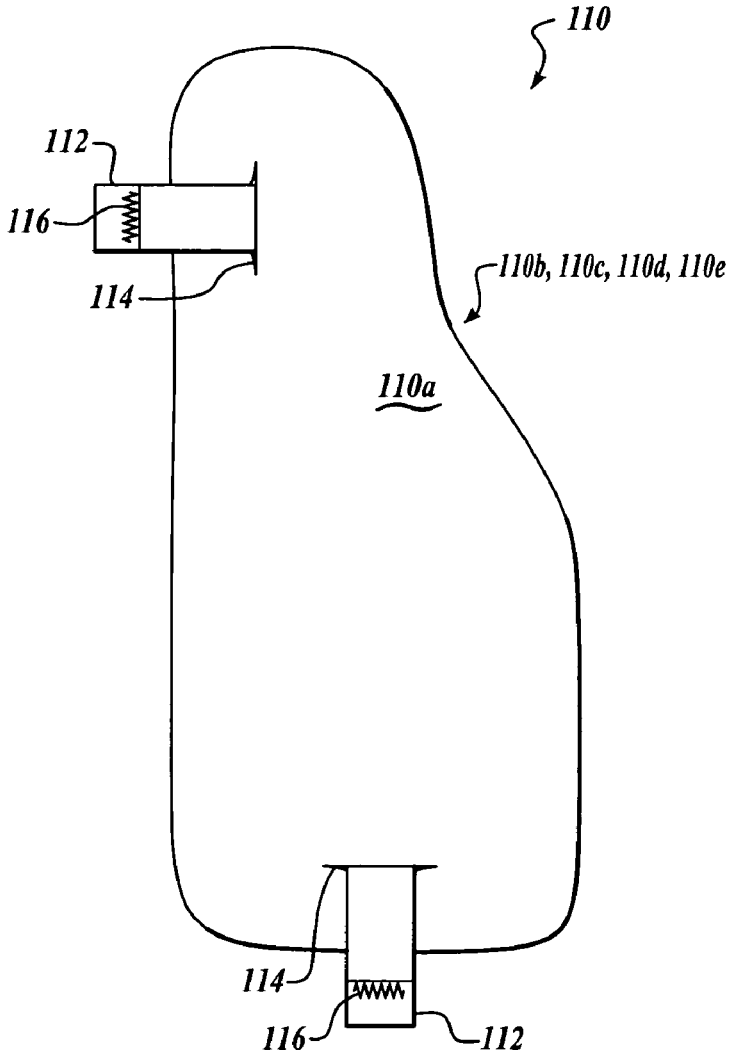
FIG. 3 is an illustration of layers of flexible buoyant foam material for use in a swimwear-style personal flotation device in accordance with a preferred embodiment of the present invention.
Figure 4:
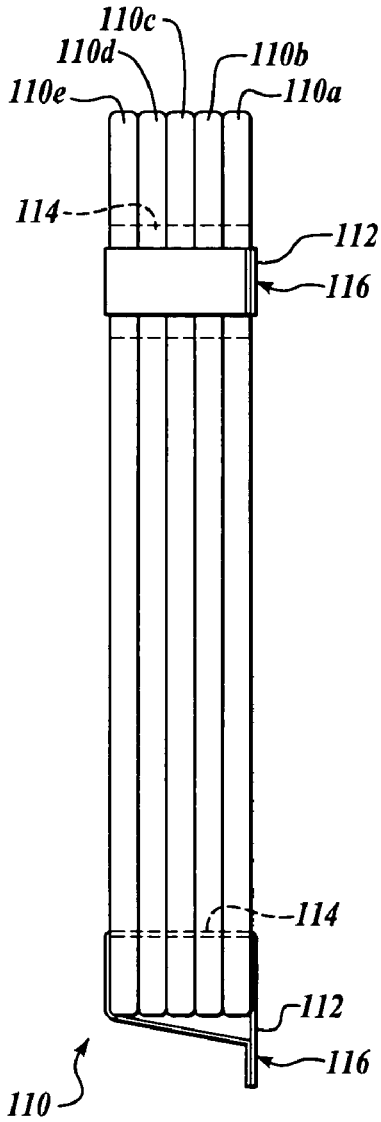
FIG. 4 is the side view of the layers of flexible buoyant foam material illustrated in FIG. 2.

The foam stabilization system and method of the present invention is described more particularly with reference to FIGS. 3 and 4. In the preferred embodiment, buoyant material incorporated into the front right segment 20, the front left segment 22, the back right segment 24 and the back left segment 26 includes multiple layers of buoyant material secured together to limit movement of the buoyant material within the vest 10.

More specifically, the preferred foam stabilization system 110 of the present invention includes multiple layers 110*a*, 110*b*, 110*c*, 110*d* and 110*e*. These layers are preferably made from a flexible buoyant material such as polyethylene foam. Five layers of buoyant material are described. However, the number of layers used may vary according to the operational needs for the particular personal flotation device. For example, smaller children may require less buoyant material in the vest segments than larger children, and therefore fewer layers may be required. Likewise, the number of layers may vary for each segment of the personal flotation device.

The foam layers 110*a*, 110*b*, 110*c*, 110*d* and 110*e* are preferably secured to each other by way of a fabric band 112 inserted into one or more slits or other apertures 114 formed through the layers. Once passed through the slits in the foam layers, the ends of the fabric band 112 are preferably sewn together along seam line 116. The type of fabric band used to secure the foam layers may vary, but is preferably made from United States Coast Guard approved fabric designed to maintain its shape and strength under conditions associated with the use of personal flotation devices. Alternative ways to secure the foam layers to each other include other types of fabric bands, bands made out of different material, such as rope, wire, cable or a variety of synthetic materials. Likewise, while the thread used to secure the ends of the fabric band together may vary, it is preferably United States Coast Guard approved thread designed to maintain its integrity under conditions associated with the use of personal flotation devices. Alternatives ways to secure the ends of the fabric band together include tacking, gluing, heat bonding, radio frequency (RF) welding and Velcro.

FIGS. 3 and 4 show the preferred embodiment of the present invention utilizing two slits through the multiple layers of buoyant material. Virtually any number of slits may be used to facilitate securing the multiple layers and achieving the benefits of foam stabilization in the personal flotation device. The number of slits may vary according to the size of the layers of buoyant material. Larger personal flotation devices may require more than two slits to secure the layers of buoyant material. Conversely, only a single slit may be required to secure the layers needed for a small personal flotation device.

In a similar fashion, the number of slits may vary according to the shape of layers of buoyant material. The preferred embodiment is directed to a personal flotation device for use in supporting the upper torso of a user. This dictates that the layers of buoyant material be in the shape of a torso. In this embodiment, using two slits to secure the layers of buoyant material improves foam stabilization by limiting the distance the foam layers can shift from their prescribed location and reducing curling or fanning of the material. Alternative embodiments may require a different number of slits. For example, a belt-shaped personal flotation device may require only a single slit to appreciably limit movement of multiple layers of buoyant material. Conversely, a more elaborately shaped vest or swimsuit-style personal flotation device may require more than two slits to appreciably limit movement of the multiple layers of buoyant material.

Figure 5:
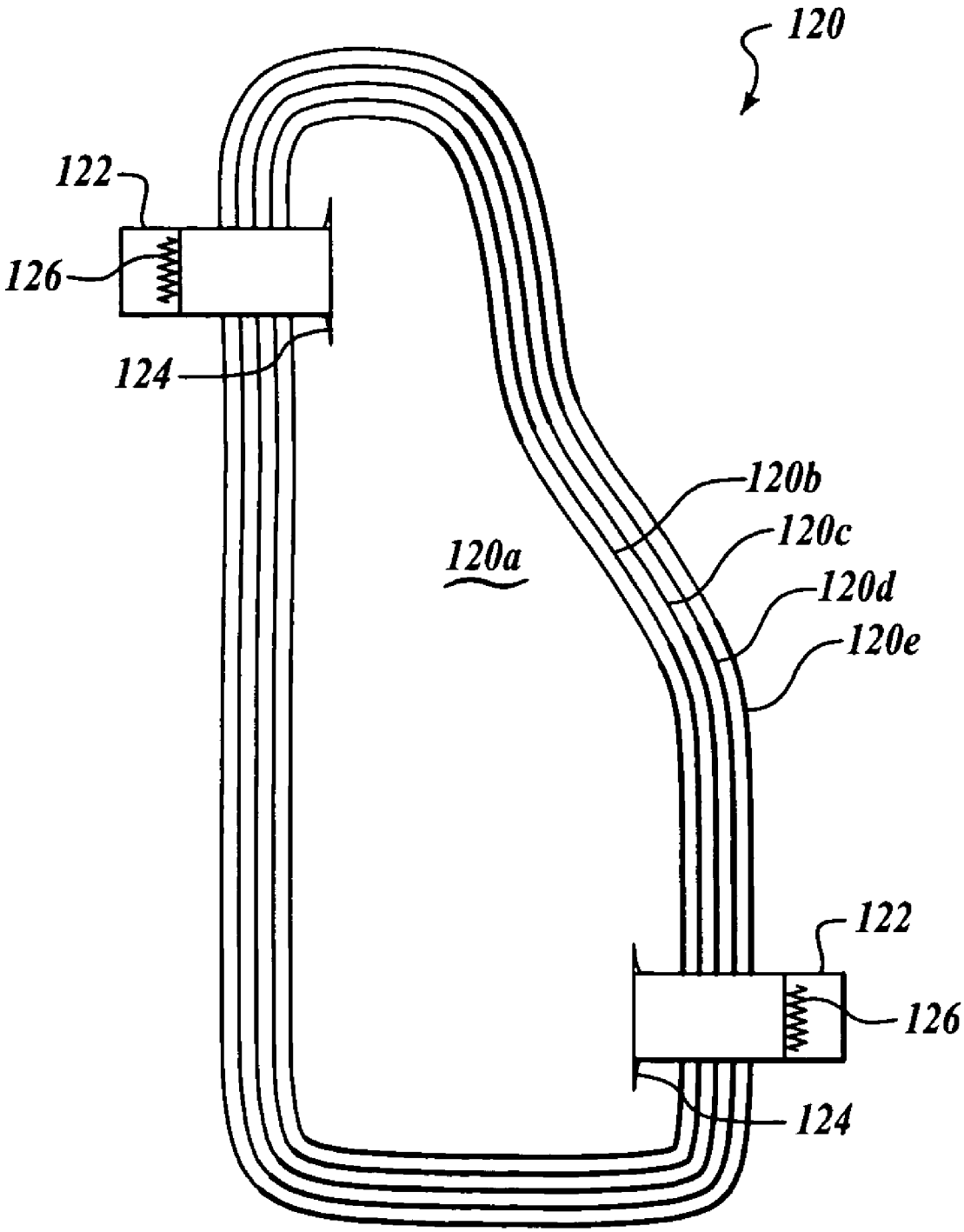
FIG. 5 is an illustration of layers of flexible buoyant foam material for use in a swimwear-style personal flotation device in accordance with an alternative embodiment of the present invention.

As shown with reference to FIG. 5, the size and shape of the multiple layers of buoyant material may be varied without losing the advantages associated with the present invention. FIG. 5, for example, shows an alternative foam stabilization system 120 in which the layers of buoyant material (120*a*, 120*b*, 120*c*, 120*d* and 120*e*) are of different sizes and shapes to create a beveled edge or the overlay of a larger layer (120*e*) to create a rounded edge. Use of these different sizes and shapes would normally subject the layers of buoyant material to increased curling and fanning and a corresponding diminishment in the effectiveness of the personal flotation device. By using the present invention, including the fabric band 122 inserted into one or more slits 124 formed through the layers, the ends of which are preferably secured along seam line 126, the buoyant material in these types of shapes is not as susceptible to the curling and fanning problems.

Figure 6:
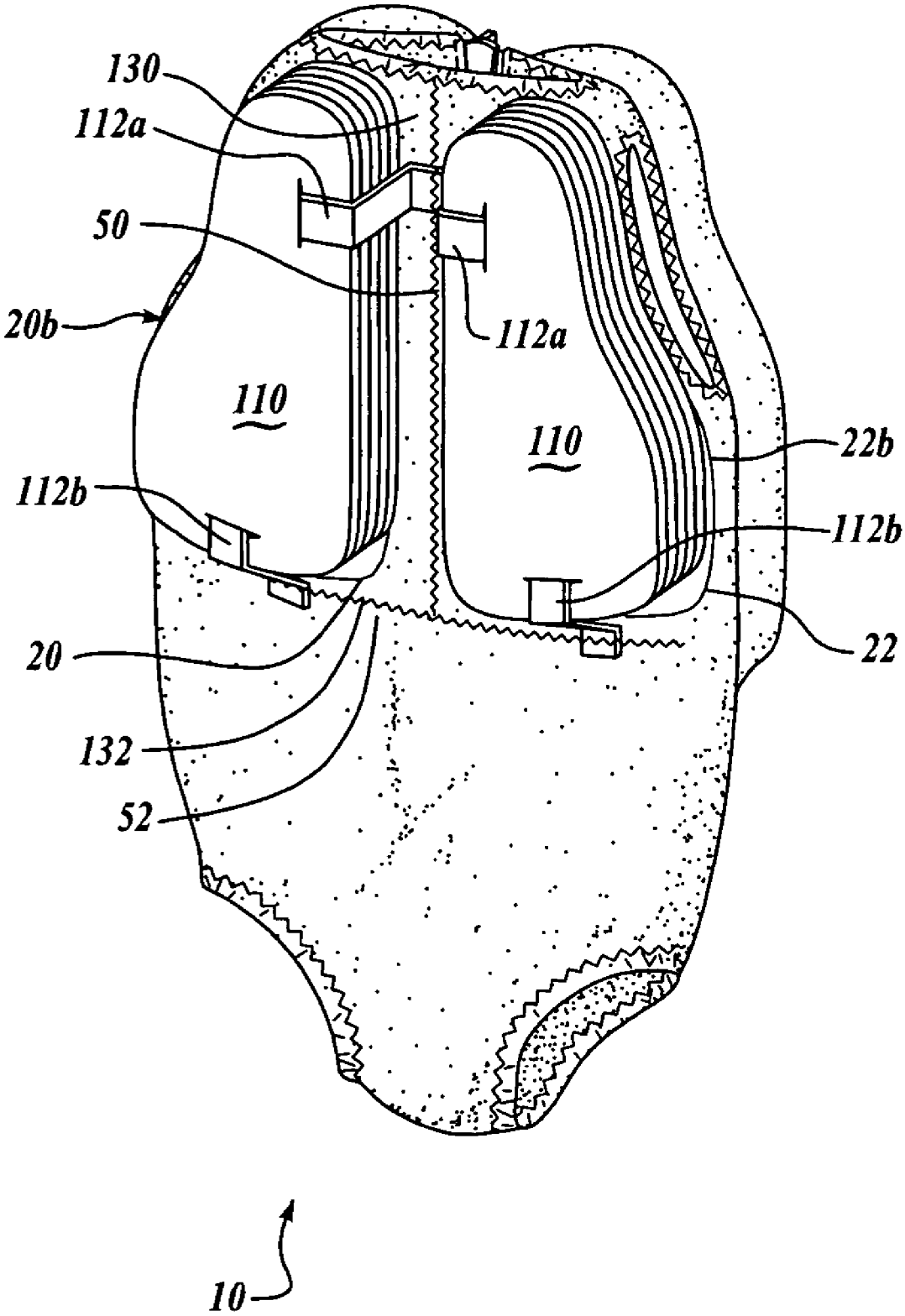
FIG. 6 is a cutaway front view of the swimwear-style personal flotation device shown in FIG. 1 illustrating the layers of flexible buoyant foam material used in a swimwear-style personal flotation device in accordance with a preferred embodiment of the present invention.
Figure 7:
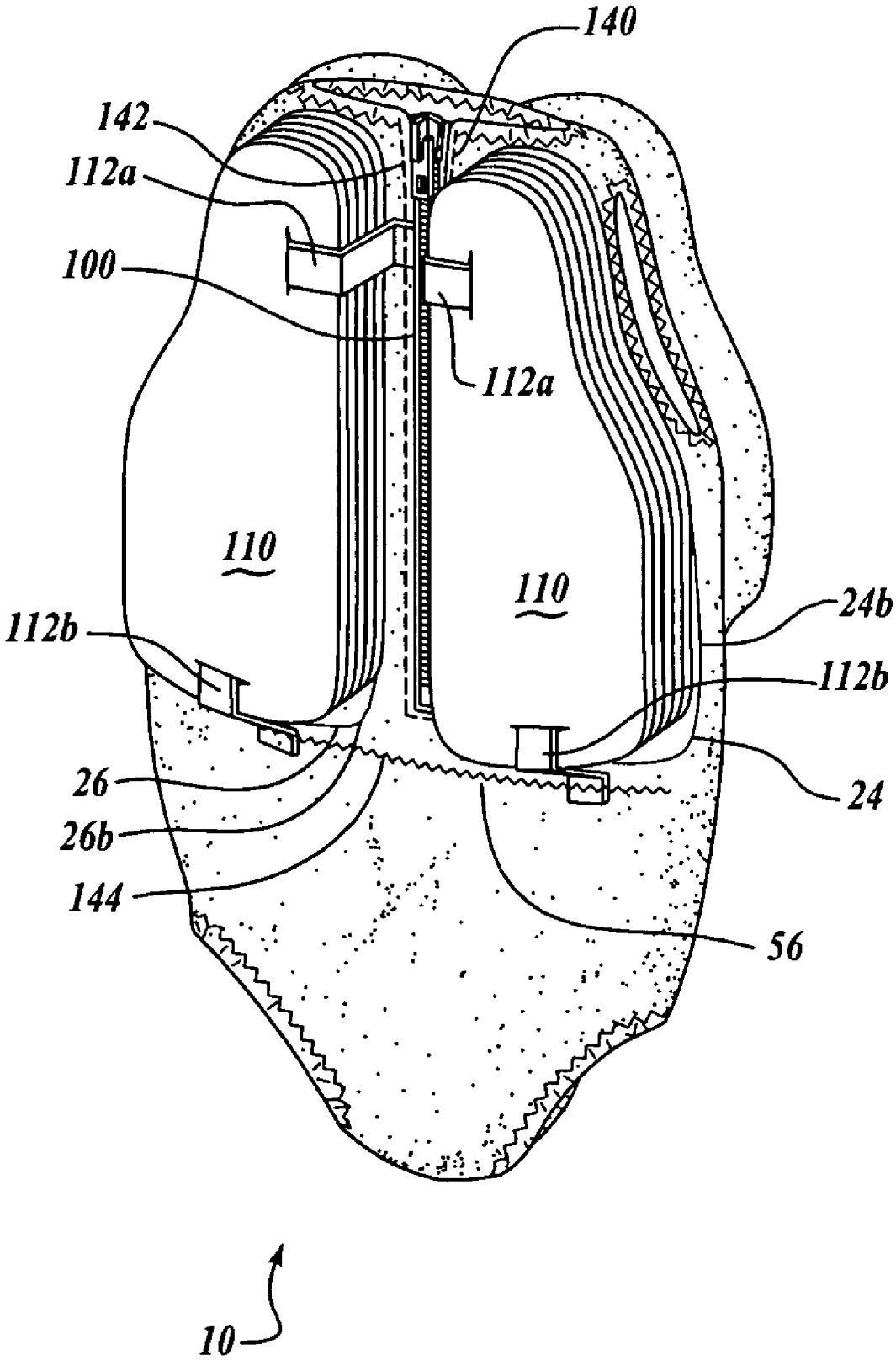
FIG. 7 is a cutaway back view of the swimwear-style personal flotation device shown in FIG. 2 illustrating the layers of flexible buoyant foam material used in a swimwear-style personal flotation device in accordance with a preferred embodiment of the present invention.

In an alternative embodiment, as shown with reference to FIGS. 6 and 7, the fabric bands 112*a* and 112*b* are used to further secure the multiple layers of buoyant material of the foam stabilization system 110 within the exterior fabric shells 20*a*, 22*a*, 24*a* and 26*a* and the interior fabric liners 20*b*, 22*b*, 24*b* and 26*b*. This is preferably accomplished by connecting the fabric bands 112*a* and 112*b* to the exterior fabric shells 20*a*, 22*a*, 24*a* and 26*a* or the interior fabric liners 20*b*, 22*b*, 24*b* and 26*b* along one or more of the seam lines 40–46, 50–52, 56 and 68–80. Alternatively, the fabric bands 112*a* and 112*b* may be attached to the shell and liner fabric at a different location and separate from any seam lines, depending on the location of the slit and corresponding fabric band through the layers of buoyant material.

In this example, with reference to FIG. 6, the layers of buoyant material incorporated into front right segment 20 are connected to the exterior fabric shell 20*a* (not shown) and to the interior fabric liner 20*b* by catching the fabric band 112*a* in the stitching 130 along the seam line 50 and catching the fabric band 112*b* in the stitching 132 along the seam line 52. The layers of buoyant material incorporated into front left segment 22 are connected to the exterior fabric shell 22*a* (not shown) and to the interior fabric liner 22*b* by catching the fabric band 112*a* in the stitching 130 along the seam line 50 and catching the fabric band 112*b* in the stitching 132 along the seam line 52.

With reference to FIG. 7, the layers of buoyant material incorporated into back right segment 24 are connected to the exterior fabric shell 24*a* (not shown) and to the interior fabric liner 24*b* by catching the fabric band 112*a* in the stitching 140 along zipper 100 and catching the fabric band 112*b* in the stitching 144 along the seam line 56. The layers of buoyant material incorporated into back left segment 26 are connected to the exterior fabric shell 26*a* (not shown) and to the interior fabric liner 26*b* by catching the fabric band 112*a* in the stitching 142 along zipper 100 and catching the fabric band 112*b* in the stitching 144 along the seam line 56.

The present invention offers advantages over personal flotation devices incorporating solid foam materials. By using multiple layers of flexible foam material, such as polyethylene foam, the present invention provides improved stabilization while avoiding inflexible, bulky and heavy vests that are not only cosmetically unappealing but may be too cumbersome to successfully incorporate into swimwear-style personal flotation devices for children. By securing the multiple layers of flexible foam material using the slit locations, the present invention reduces curling and fanning issues that may alter the attitude of the user in the water and threaten the proper performance of the personal flotation device.

While the preferred embodiment of the invention has been illustrated and described, as noted above, many changes can be made without departing from the spirit and scope of the invention. While specific details of certain embodiments of the invention are set forth in the preceding description and in FIGS. 1–7 in order to provide a thorough understanding of such embodiments, the present invention may have additional embodiments or be practiced without several of the described details. For example, the personal flotation device may be of various shapes and include a different number of segments. In an alternative embodiment, the personal flotation device 10 may have fewer than four segments connected together to form a vest shape. For example, a single front segment and a single back segment may be connected together to form a vest shape. In yet an alternative embodiment, multiple segments may be connected to form a personal flotation device other than in the shape of a vest. For example, two front segments may be connected around the neck of the user in a horse collar configuration. This alternative embodiment may further include support straps connected to the front segments and encircling the user to maintain the front segments on the user to maximize appropriate flotation. In another alternative embodiment, a single segment, either in the front or the back, may be removably connected via straps to the user to provide appropriate flotation.

In yet alternative embodiments, the zipper of the personal flotation device may be located along the front or sides of the vest. Alternatively, no zipper may be used, but rather the segments may be expanded to allow fitting to a user by stretchable fabric, buttons, clasps, Velcro or other similar connection methods.

In still alternative embodiments, one or more of the distinct segment may be merged with other segments such that several segments of the vest 10 are formed from unitary fabric material, thus reducing the need to connect separate fabric segments. Likewise, the buoyant material may be incorporated into a single piece of multiple layer fabric material rather than retained by connecting a separate shell and liner.

In addition, the precise location of seam lines may vary according to the desired shape and size of the vest 10. The fabric segments of the vest 10 may be connected together using a variety of methods including sewing, tacking, gluing, heat bonding, RF welding and Velcro. Likewise, in addition to sewing, the fabric band 112 or 122 may be connected to the front right segment 20, the front left segment 22, the back right segment 24 and the back left segment 26 by other methods such as tacking, gluing, heat bonding, RF welding and Velcro.

Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A personal flotation device, comprising:

a cover forming a compartment;

a plurality of layers of flexible and buoyant foam material adjacent each other within the covered compartment;

an aperture in the layers of buoyant material;

a flexible stabilizer passed through the aperture in the layers of buoyant material, wherein the stabilizer limits substantial separating movement of each layer of buoyant material relative to the other layers of buoyant material, while allowing shifting of each layer relative to the other layers;

a second aperture in the layers of buoyant material; and a second stabilizer passed through the second aperture in the layers of buoyant material, wherein the first stabilizer and the second stabilizer limit the movement of each layer of buoyant material relative to the other layers of buoyant material.

2. The personal flotation device of claim 1, wherein the cover is made of stretchable fabric.

3. The personal flotation device of claim 2, wherein the stretchable fabric includes neoprene.

4. The personal flotation device of claim 1, wherein the cover forms a plurality of compartments and a plurality of layers of buoyant material adjacent each other are within each covered compartment.

5. The personal flotation device of claim 1, wherein the stabilizer passed through the aperture in the layers of buoyant material is connected to the cover of the personal flotation device.

6. A personal flotation device, comprising:

a front segment having a cover forming a compartment and a back segment having a cover forming a compartment, wherein the front segment and the back segment are connected together to form a vest shape; and a plurality of layers of flexible buoyant foam material adjacent each other within at least one of the compartment of the front segment and the compartment of the back segment, comprising;

an aperture in the layers of buoyant material;

a flexible stabilizer passed through the aperture in the layers of buoyant material, wherein the stabilizer limits substantial separating movement of each layer of buoyant material relative to the other layers of buoyant material, while allowing shifting of each layer relative to the other layers, wherein the plurality of layers of buoyant material adjacent each other within at least one of the compartment of the front segment and the compartment of the back segment further comprises;

a second aperture in the layers of buoyant material; and a second flexible stabilizer passed through the aperture in the layers of buoyant material, wherein the first stabilizer and the second stabilizer limit substantial separating movement of each layer of buoyant material relative to the other layers of buoyant material, while allowing shifting of each layer relative to the other layers.

7. The personal flotation device of claim 6, wherein the cover of the front and back segments are made of stretchable fabric.

8. The personal flotation device of claim 7, wherein the stretchable fabric includes neoprene.

9. The personal flotation device of claim 6, further comprising a garment connected to the front segment and the back segment forming a partially enclosed lower torso segment of the personal flotation device.

10. A personal flotation device, comprising:

a front segment having a cover forming a compartment and a back segment having a cover forming a compartment, wherein the front segment and the back segment are connected together to form a vest shape; and a plurality of layers of flexible buoyant foam material adjacent each other within at least one of the compartment of the front segment and the compartment of the back segment, comprising:

an aperture in the layers of buoyant material;

a flexible stabilizer passed through the aperture in the layers of buoyant material, wherein the stabilizer limits substantial separating movement of each layer of buoyant material relative to the other layers of buoyant material, while allowing shifting of each layer relative to the other layers, wherein the stabilizer passed through the layers of buoyant material adjacent each other within the compartment of the front segment is directly affixed to at least one of the cover forming the compartment of the front segment and the cover forming the compartment of the back segment.

11. A method for stabilizing buoyant material incorporated into a personal flotation device, comprising combining a plurality of layers of flexible buoyant foam material adjacent each other within a covered compartment in the personal flotation device, the layers having peripheral edges;

opening an aperture in the layers of buoyant material; and looping a flexible stabilizer through the aperture in the layers of buoyant material and around a portion of the peripheral edges, wherein the stabilizer limits substantial separating movement of each layer of buoyant material relative to the other layers of buoyant material, while allowing shifting of each layer relative to the other layers.

12. The method of claim 11, wherein the personal flotation device includes a plurality of covered compartments and the step of combining a plurality of layers of buoyant material adjacent each other applies to the layers of buoyant material within each covered compartment.

13. The method of claim 11, further comprising;

opening a second aperture in the layers of buoyant material; and passing a second stabilizer through the aperture in the layers of buoyant material, wherein the first stabilizer and the second stabilizer limit the movement of each layer of buoyant material relative to the other layers of buoyant material.

14. The method of claim 11, further comprising connecting the stabilizer looped through the aperture in the layers of buoyant material directly to the covered compartment of the personal flotation device.

15. A personal flotation device, comprising a cover forming a compartment;

a plurality of layers of flexible buoyant material adjacent each other within the compartment, the layers having peripheral edges;

a means for limiting the movement of each layer of buoyant material relative to the other layers of buoyant material secured about a portion of the peripheral edges of the layers; and a means for limiting the movement of each layer of buoyant material within the compartment.

16. The personal flotation device of claim 15, wherein:

the cover forms a plurality of compartments; and a plurality of layers of buoyant material adjacent each other are within each covered compartment.

17. A personal flotation device, comprising a cover forming a plurality of compartments;

a plurality of layers of flexible buoyant material adjacent each other within at least one of the plurality of compartments, the layers having peripheral edges, the plurality of layers of buoyant material further comprising;

a first aperture in the layers of buoyant material adjacent at least one of the peripheral edges;

a first flexible stabilizer passed through the first aperture in the layers of buoyant material;

a second aperture in the layers of buoyant material; and a second flexible stabilizer passed through the second aperture in the layers of buoyant material; and wherein the first and second stabilizers passed through the first and second apertures in the layers of buoyant material are directly fastened to the cover forming the plurality of compartments.

18. The personal flotation device of claim 17, wherein the cover is made of stretchable fabric.

19. The personal flotation device of claim 18, wherein the stretchable fabric includes neoprene.

* * * * *

UNITED STATES PATENT AND TRADEMARK OFFICE

CERTIFICATE OF CORRECTION

PATENT NO. : 6,986,691 B2
DATED : January 17, 2006
INVENTOR(S) : Johnson et al.

It is certified that error appears in the above-identified patent and that said Letters Patent is hereby corrected as shown below:

Title page,
Item [73], Assignee, "Steams Inc." should read -- Stearns Inc. --.

Signed and Sealed this

Twenty-seventh Day of June, 2006

JON W. DUDAS
*Director of the United States Patent and Trademark Office*